US005725167A

United States Patent [19]

Garwood et al.

[11] Patent Number: 5,725,167

[45] Date of Patent: Mar. 10, 1998

[54] PROCESS FOR WINDING FIBER STRAND ON A BOBBIN

[75] Inventors: Charles A. Garwood, Thomasville; James E. Saunders, Lexington, both of N.C.

[73] Assignee: PPG Industries, Inc., Pittsburgh, Pa.

[21] Appl. No.: 574,870

[22] Filed: Dec. 19, 1995

[51] Int. Cl.[6] ..... B65H 54/28; B65H 55/04

[52] U.S. Cl. ..... 242/26.3; 242/178

[58] Field of Search ..... 242/26.3, 26.1, 242/31, 175, 178

[56] References Cited

U.S. PATENT DOCUMENTS

| | | | |
|---|---|---|---|
| D. 282,312 | 1/1986 | Dick | D3/24 |
| D. 292,643 | 11/1987 | Dick et al. | D3/24 |
| 1,104,818 | 7/1914 | Mitchell . | |
| 1,233,041 | 7/1917 | Foster . | |
| 1,968,406 | 7/1934 | Lambeck | 242/43 |
| 2,295,724 | 9/1942 | Edfors | 242/26.3 |
| 2,296,420 | 9/1942 | Campbell | 242/159 |
| 2,364,819 | 12/1944 | Ruddy | 242/26.3 |
| 2,848,173 | 8/1958 | Hebberling | 242/43 |
| 2,858,993 | 11/1958 | Siegenthaler | 242/43.1 |
| 3,048,000 | 8/1962 | Brutko | 57/90 |
| 3,064,922 | 11/1962 | Cochran | 242/175 |
| 3,243,131 | 3/1966 | Greive | 242/26.3 |
| 3,367,588 | 2/1968 | Wolf | 242/26.3 |
| 3,373,945 | 3/1968 | Johnson | 242/18 R |
| 3,685,764 | 8/1972 | Drummond | 242/129 |
| 3,695,529 | 10/1972 | Hori et al. | 242/26.3 |
| 3,860,194 | 1/1975 | Roscher | 242/118.32 |
| 3,998,326 | 12/1976 | McKee, Jr. | 206/407 |
| 4,055,312 | 10/1977 | Lucke | 242/43.1 |
| 4,390,647 | 6/1983 | Girgis . | |
| 4,596,366 | 6/1986 | Dick et al. | 242/118.3 |
| 4,600,165 | 7/1986 | Shoemaker | 242/118.4 |
| 4,762,750 | 8/1988 | Girgis et al. | 428/378 |
| 4,762,751 | 8/1988 | Girgis et al. | 428/378 |
| 4,789,112 | 12/1988 | Schippers et al. | 242/178 |
| 4,795,678 | 1/1989 | Girgis | 428/381 |
| 5,222,676 | 6/1993 | Rebsamen | 242/18 R |

FOREIGN PATENT DOCUMENTS

| | | | |
|---|---|---|---|
| 502849 | 3/1938 | United Kingdom | 242/178 |
| 1072646 | 6/1967 | United Kingdom . | |
| 1198077 | 7/1970 | United Kingdom . | |

OTHER PUBLICATIONS

K. L. Loewenstein, "The Manufacturing Technology of Continuous Glass Fibres", (2d Ed. 1983), pp. 23, 29, 33–45, 47–60, 118–120, 122–125, 169–177, 224–230, 243–295, 322, 333–339.

"PPG Fiber Glass Yarn Products and Packaging", a Technical Bulletin of PPG Industries, Inc., Mar., 1994.

"PPG Fiber–Glass Yarn Products/Handbook", A Technical Bulletin of PPG Industries, Inc. Mar. 1994.

*Primary Examiner*—Michael R. Manson
*Attorney, Agent, or Firm*—Ann Marie Odorski

[57] ABSTRACT

A process for winding a fiber strand about a bobbin to form a wound package includes: (a) winding a fiber strand about a portion of a bobbin supported upon a rotatable collector of a winder to form a primary layer of a wound package. The primary layer has an overall length, an upper portion and a lower portion. Each of the upper portion and lower portion have a length which is less than the overall length. The primary layer has a plurality of sublayers, each of the plurality of sublayers having a plurality of layers. Each of the plurality of layers of the sublayers is successively wound upon a preceding layer and has a length which is less than the preceding layer. Each of the plurality of layers of the sublayers has an outer layer having a length which corresponds generally to the length of the lower portion, such that the primary layer is formed. A secondary layer is formed thereon which includes a plurality of layers upon the primary layer. Each of the plurality of layers is successively wound upon a preceding layer and has a length which is less than the preceding layer. The length of each of the plurality of layers has a midpoint which corresponds to a midpoint of the overall length of the primary layer, such that a wound package is formed.

16 Claims, 3 Drawing Sheets

PROCESS FOR WINDING FIBER STRAND ON A BOBBIN

FIELD OF THE INVENTION

The present invention relates to a process for winding a fiber strand upon a bobbin to form a wound package and, more particularly, for winding the package using a combination of different builds to facilitate unwinding of the package.

BACKGROUND OF THE INVENTION

In response to demands for increased productivity and efficiency, users of wound fiber strand packages, such as weavers and knitters, continually challenge producers to provide high quality wound packages having maximum usable product with minimum waste. Several problems which confront producers include uneven strand tension, which can cause product irregularity in subsequent processes such as knitting and weaving, and strands which become entrapped within layers of the package and between the package and the bottom flange of the bobbin during winding or transport, which can cause the strand to abrade or break during unwinding. Uneven strand tension and processing interruptions due to entrapped strands cause waste and reduced productivity.

U. S. Pat. No. 5,222,676 attempts to address the problem of uneven strand tension by a process for producing a yarn package in which a constant traverse length is maintained during winding until the package reaches a predetermined diameter, then continuously reducing the traverse length for the remainder of the winding. However, the problem of trapped strands is not addressed by this patent.

It is desirable to reduce or eliminate trapped strands from wound packages, both near the bottom flange and throughout the package, as well as to provide a generally uniform tension to the strand. A process is needed which facilitates winding, manipulation and transportation of packages to reduce waste and thereby increase efficiency and productivity.

SUMMARY OF THE INVENTION

The present invention provides a process for winding a fiber strand about a bobbin to form a wound package, the process comprising the steps of: (a) winding a fiber strand about a portion of a bobbin supported upon a rotatable collector of a winder to form a primary layer of a wound package, the primary layer having an overall length, an upper portion and a lower portion, each of the upper portion and lower portion having a length which is less than the overall length, the primary layer comprising a plurality of sublayers, each of the plurality of sublayers comprising a plurality of layers, each of the plurality of layers of the sublayers being successively wound upon a preceding layer and having a length which is less than the preceding layer, each of the plurality of layers of the sublayers having an outer layer having a length which corresponds generally to the length of the lower portion, such that the primary layer is formed; and (b) forming a secondary layer comprising a plurality of layers upon the primary layer, each of the plurality of layers being successively wound upon a preceding layer and having a length which is less than the preceding layer, the length of each of the plurality of layers having a midpoint which corresponds to a midpoint of the overall length of the primary layer, such that a wound package is formed.

BRIEF DESCRIPTION OF THE DRAWINGS

The foregoing summary, as well as the following detailed description of the preferred embodiments, will be better understood when read in conjunction with the appended drawings. In the drawings.

DETAILED DESCRIPTION OF THE INVENTION

The process of the present invention reduces or eliminates trapped ends from wound packages and increases the uniformity of the tension of the strand to facilitate subsequent unwinding.

Figures 1, 1A:
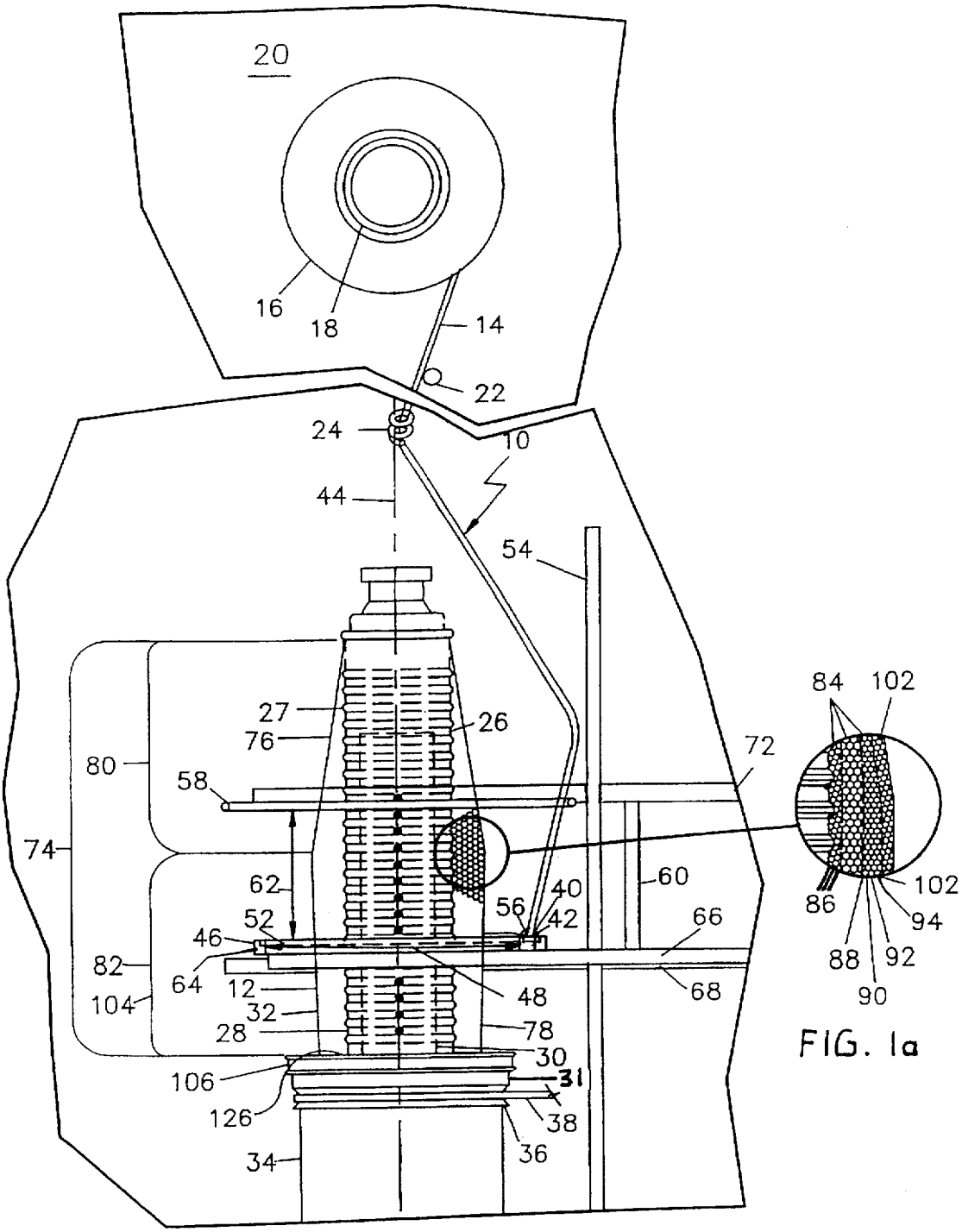
FIG. 1 is a schematic front elevational view of an apparatus for producing a wound package showing winding of the primary layer of fiber strand, in accordance with the process of the present invention.
FIG. 1*a* is an enlarged view of a portion of FIG. 1 showing a plurality of sublayers of the primary layer.
Figures 2, 2A:
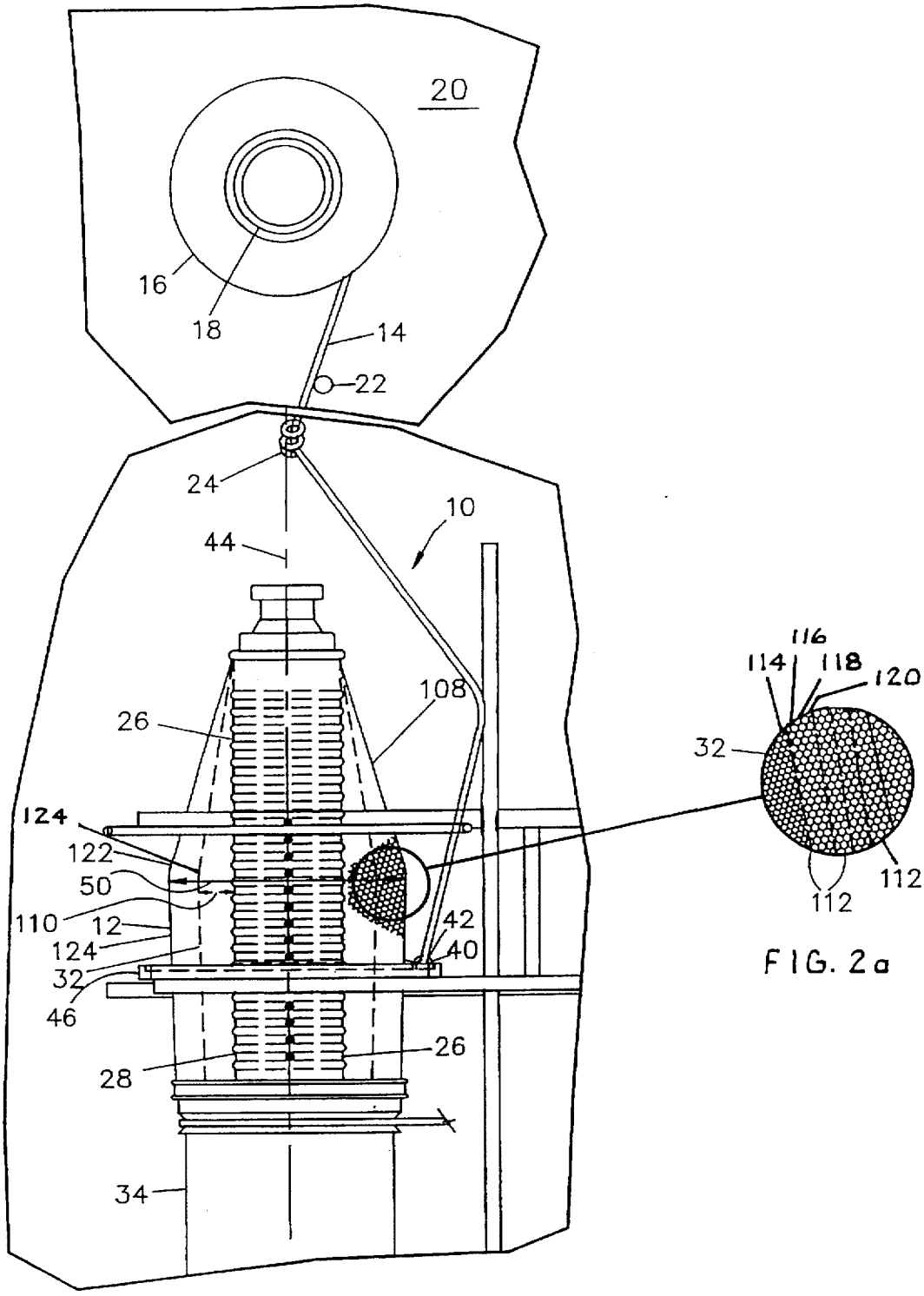
FIG. 2 is a schematic front elevational view of the apparatus for producing a wound package showing winding of the secondary layer of fiber strand, in accordance with the process of the present invention.
FIG. 2*a* is an enlarged view of a portion of FIG. 2 showing a plurality of layers of the secondary layer.

Referring to the drawings, wherein like numerals indicate like elements throughout, there is shown in FIGS. 1–2 a preferred embodiment of a winder, generally designated 10, for winding a wound package 12, in accordance with the process of the present invention.

The wound package 12 is formed from a generally continuous fiber strand 14. As used herein, the phrases "fiber strand" or "strand" mean an individual filament or fiber or a plurality of individual filaments or fibers grouped together in generally parallel form, a non-limiting example of which is a yarn. The present invention is generally useful in the winding of fiber strands, yarns or the like of natural or man-made materials. Fibers believed to be useful in the present invention are discussed at length in the *Encyclopedia of Polymer Science and Technology*, Vol. 6 (1967) at pages 505–712, which is hereby incorporated by reference.

Suitable natural materials include those derived directly from animal, vegetable and mineral sources. *Encyclopedia of Polymer Science and Technology*, Vol. 6 at 505–506; 522–542; 691–712. Examples of methods for preparing and processing such natural fibers are also discussed in the *Encyclopedia of Polymer Science and Technology*, Vol. 6 at 709–712. Further discussion thereof is not believed to be necessary in view of the above and the present disclosure. Non-limiting examples of animal and vegetable-derived natural materials include cotton, cellulose, natural rubber, flax, ramie, hemp, sisal and wool. Examples of suitable minerals include mineral wool and basalt.

Suitable man-made fibers can be formed from a fibrous or fiberizable material prepared from natural organic polymers, synthetic organic polymers or inorganic substances. *Encyclopedia of Polymer Science and Technology*, Vol. 6 at 506–507. As used herein, the term "fiberizable" means a material capable of being formed into a generally continuous filament, fiber, strand or yarn.

Man-made fibers produced from natural organic polymers are regenerated or derivative. *Encyclopedia of Polymer Science and Technology*, Vol. 6 at 506. A regenerated fiber is formed when a natural polymer or its chemical derivative is dissolved and extruded as a continuous filament which retains, or after fiber forming has regenerated, the chemical nature of the natural polymer. Encyclopedia of Polymer Science and Technology, Vol. 6 at 506. An example of a regenerated fiber is a regenerated cellulosic fiber. *Encyclopedia of Polymer Science and Technology*, Vol. 6 at 542–548. A derivative fiber is formed when a chemical derivative of the natural fiber is prepared, dissolved and extruded as a continuous filament which retains the chemical nature of the derivative. *Encyclopedia of Polymer Science and Technology*, Vol. 6 at 506.

Man-made fibers can also be based upon synthetic polymers such as polyamides, polyesters, acrylics, polyolefins, polyurethanes, vinyl polymers, derivatives and mixtures thereof. *Encyclopedia of Polymer Science and Technology*, Vol. 6 at 506.

Suitable man-made fibers can be formed by a variety of polymer extrusion and fiber formation methods, such as for example drawing, melt spinning, dry spinning, wet spinning and gap spinning. Such methods are well known to those skilled in the art and further discussion thereof is not believed to be necessary in view of the present disclosure. If additional information is needed, such methods are disclosed in *Encyclopedia of Polymer Science and Technology*, Vol. 6 at 507–508.

Non-limiting examples of useful polyamide fibers include nylon fibers such as nylon 6 (a polymer of caprolactam), nylon 6,6 (a condensation product of adipic acid and hexamethylenediamine), nylon 12 (which can be made from butadiene) and nylon 10. Many of these nylons are commercially available from E.I. duPont de Nemours and Company of Wilmington, Del. and BASF Corp. of Parsippany, N.J. Other useful polyamide fibers include polyhexamethylene adipamide, polyamide-imides and aramids such as KEVLAR™, which is commercially available from duPont.

Thermoplastic polyester fibers useful in the present invention include those composed of at least 85% by weight of an ester of a dihydric alcohol and terephthalic acid, such as polyethylene terephthalate (for example DACRON™ which is commercially available from duPont and FORTREL™ which is commercially available from Hoechst Celanese Corp. of Summit, N.J.) and polybutylene terephthalate.

Fibers formed from acrylic polymers believed to be useful in the present invention include polyacrylonitriles having at least about 35% by weight acrylonitrile units, and preferably at least about 85% by weight, which can be copolymerized with other vinyl monomers such as vinyl acetate, vinyl chloride, styrene, vinylpyridine, acrylic esters or acrylamide. *See Encyclopedia of Polymer Science and Technology*, Vol. 6 at 559–561. A non-limiting example of a suitable acrylic polymer fiber is ORLON™, a copolymer which contains at least 85% acrylonitrile which is commercially available from duPont.

Useful polyolefin fibers are generally composed of at least 85% by weight of ethylene, propylene, or other olefins. *See Encyclopedia of Polymer Science and Technology*, Vol. 6 at 561–564.

Fibers formed from vinyl polymers believed to be useful in the present invention can be formed from polyvinyl chloride, polyvinylidene chloride (such as SARAN™, which is commercially available from Dow Plastics of Midland, Mich.), polytetrafluoroethylene, and polyvinyl alcohol (such as VINYLON™, a polyvinyl alcohol fiber which has been crosslinked with formaldehyde).

Further examples of fiberizable thermoplastic materials believed to be useful in the present invention are fiberizable polyimides, polyether sulfones, polyphenyl sulfones; polyetherketones, polyphenylene oxides, polyphenylene sulfides and polyacetals.

Suitable elastomeric fibers are synthetic rubbers or spandex polyurethanes in which the fiber-forming substance is a long-chain synthetic polymer comprised of at least 85% by weight of a segmented polyurethane having alternating soft and hard regions in the polymer structure. See *Encyclopedia of Polymer Science and Technology*, Vol. 6 at 564–566 and 573–591. As used herein, the term "elastomeric fiber" means a fiber that will recover from long-range deformations immediately upon removal of the deforming force. *Encyclopedia of Polymer Science and Technology*, Vol. 6 at 564. A commercial spandex fiber is LYCRA™, which is available from duPont.

It is understood that blends or copolymers of any of the above materials and combinations of fibers formed from any of the above materials can be used in the present invention, if desired.

Suitable inorganic fibers are discussed in the *Encyclopedia of Polymer Science and Technology*, Vol. 6 at 610–690 and include glass and polycrystalline fibers, such as ceramics including silicon carbide, and carbon or graphite.

The preferred fibers for use in the present invention are glass fibers, a class of fibers generally accepted to be based upon oxide compositions such as silicates selectively modified with other oxide and non-oxide compositions. Useful glass fibers can be formed from any type of fiberizable glass composition known to those skilled in the art, and include those prepared from fiberizable glass compositions such as "E-glass", "A-glass", "C-glass", "D-glass", "R-glass", "S-glass", and E-glass derivatives that are fluorine-free and/or boron-free. Such compositions and methods of making glass filaments therefrom are well known to those skilled in the art and further discussion thereof is not believed to be necessary in view of the present disclosure. If additional information is needed, such glass compositions and fiberization methods are disclosed in K. Loewenstein, *The Manufacturing Technology of Glass Fibres*, (2d Ed. 1983) at pages 29, 33–45, 47–60, 118–120 and 122–125, which is hereby incorporated by reference.

Combinations of fibers formed from any of the above organic and inorganic materials can be used in the present invention.

Preferably, one or more coating compositions are present on at least a portion of the surfaces of the glass fibers to protect the surfaces from abrasion during processing. Non-limiting examples of suitable coating compositions include sizing compositions and secondary coating compositions. As used herein, the terms "size", "sized" or "sizing" refer to the aqueous composition applied to the filaments immediately after formation of the glass fibers. The term "secondary coating" refers to a coating composition applied secondarily to one or a plurality of strands after the sizing composition is applied, and preferably at least partially dried.

Typical sizing compositions can include as components film-formers, lubricants, coupling agents, emulsifiers, antioxidants, ultraviolet light stabilizers, colorants, antistatic agents and water, to name a few. Examples of suitable sizing compositions are set forth in *Loewenstein* at pages 243–295 (2d Ed. 1983) and U.S. Pat. Nos. 4,390,647 and 4,795,678, each of which is hereby incorporated by reference.

The sizing can be applied in many ways; for example by contacting the filaments with a static or dynamic applicator, such as a roller or belt applicator, spraying, or other means, examples of which are disclosed in *Loewenstein* at pages 169–177, which is hereby incorporated by reference.

The sized fibers are preferably dried at room temperature or at elevated temperatures. Suitable ovens for drying glass fibers are well known to those of ordinary skill in the art. Drying of glass fiber forming packages or cakes is discussed in detail in *Loewenstein* at pages 224–230, which is hereby incorporated by reference. For example, the forming package can be dried in an oven at a temperature of about 104° C. (220° F.) to about 160° C. (360° F.) for about 10 to about 13 hours to produce glass fiber strands having a dried residue of the curable composition thereon. The temperature and time for drying the glass fibers will depend upon such variables as the percentage of solids in the sizing composition, components of the sizing composition and type of glass fiber. The sizing is typically present on the fibers in an amount between about 0.1 percent and 5 percent by weight after drying.

After drying, the sized glass strands can be gathered together into bundles of generally parallel fibers and can be further treated with a secondary coating composition which is different from the sizing composition. As used herein, the term "bundle" refers to a plurality of fibers. The secondary coating composition can include one or more of the components of the sizing composition discussed above, and is preferably aqueous-based. Non-limiting examples of suitable secondary coating compositions are disclosed in U.S. Pat. Nos. 4,762,750 and 4,762,751, which are hereby incorporated by reference.

The secondary coating composition is applied to at least a portion of the surface of the strands in an amount effective to coat or impregnate the portion of the strands. The secondary coating composition can be conventionally applied by dipping the strand in a bath containing the composition, by spraying the composition upon the strand or by contacting the strand with an applicator such as a roller or belt applicator, for example. The coated strand can be passed through a die to remove excess coating composition from the strand and/or dried as discussed above for a time sufficient to at least partially dry or cure the secondary coating composition.

The present invention will now be discussed generally in the context of its use in the winding of glass fiber strands. However, one of ordinary skill in the art would understand that the present invention is useful in the processing of any of the fibers discussed above.

Figure 3:
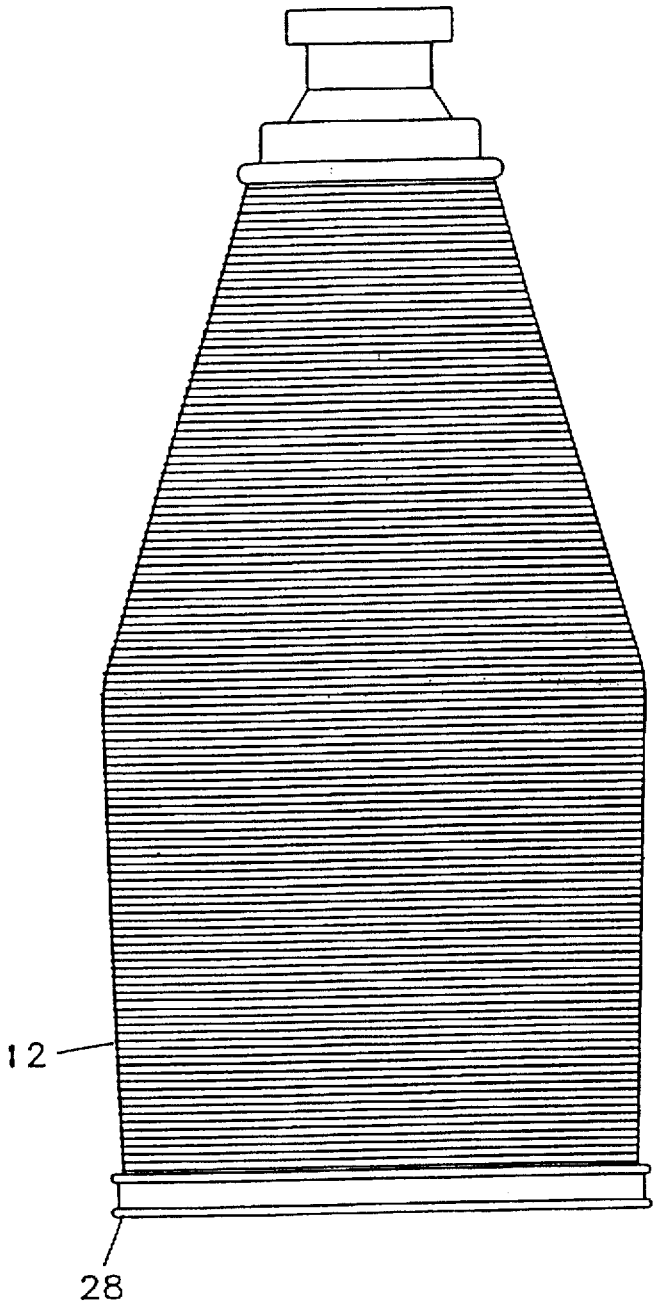
FIG. 3 is a front elevational view of a wound package produced according to the process of the present invention.

Referring now to FIGS. 1–3, the strand(s) 14 are supplied to the winder 10 by one or more fiber supply or forming packages 16. About 1 to about 60 forming packages can be used, and more preferably a single forming package is used. A single forming package 16 is shown in FIGS. 1–2 for purposes of clarity in the drawings. One skilled in the art would understand that more than one forming package can be used, if desired.

As shown in FIG. 1, the forming package 16 has at least one fiber or strand 14 wound thereon. In the preferred process, each strand 14 comprises a plurality of generally linear filaments, for example continuous glass filaments.

Typical forming packages 16 are generally cylindrically-shaped and have a hollow center. The strand 14 can be drawn from the inside or the outside of the forming package 16, but preferably is drawn from the outside of the forming package 16 for textile yarn manufacturing. The dimensions of the forming package 16 can vary, depending upon such variables as the diameter and type of fiber wound thereon, and are generally determined by convenience for later handling and processing. Generally, forming packages 16 are about 15.2 to about 76.2 centimeters (about 6 to about 30 inches) in diameter and have a length of about 5.1 to about 101.6 centimeters (about 2 to about 40 inches). Conventional supply or forming package 16 dimensions are set forth in U.S. Pat. Nos. 3,685,764 and 3,998,326, each of which is hereby incorporated by reference. The sides of the forming package 16 can be tapered or rounded.

Referring to FIGS. 1 and 2, the forming package 16 is supported by a rotatable support 18, preferably by positioning the hollow of the package 16 upon the support 18. The support 18 is attached to a frame 20, which can be a portion of the winder 10 as shown in FIGS. 1 and 2 or a portion of a separate, free-standing frame such as a creel. The frame 20 can be formed from a rigid material such as stainless steel, carbon steel or aluminum. Conventional creels suitable for use in the present invention are shown in *Loewenstein* at page 322, which is hereby incorporated by reference.

Preferably the rotatable support 18 is a driven roll which is rotated at a predetermined speed by a drive device to unwind the forming package 16. Suitable drive devices including motors are well known to those skilled in the art and further discussion thereof is not believed to be necessary. The support 18 can be rotated at a constant speed or preferably at a varying speed. The speed at which the support 18 is rotated can be about 50 to about 300 revolutions per minute (rpm), and preferably about 100 to about 250 rpm. Preferably, the support is rotated at an average constant speed such that the strand 14 is fed to the winder 10 at a generally constant average feed rate of about 50 to about 300 meters/minute, and more preferably about 100 to about 250 meters/minute.

The winder 10 can further include a drop wire device 22 or other similar device which ensures that the strand 14 being provided to the winder 10 has not broken. The drop wire device 22 includes a rigid member or wire, a biasing means and a signaling means for signaling an operator (not shown) or the winder 10 to stop the winder 10 when contact between the wire and strand 14 is interrupted, for example when the strand 14 breaks. Other suitable strand interruption devices are well known to those skilled in the art and further discussion thereof is not believed to be necessary.

The winder 10 can further include a strand alignment device. The strand alignment device aligns the strand received from the forming package 16 with a rotatable collector of the winder to facilitate winding. A non-limiting example of a suitable strand alignment device is a coil or pig-tail 24, shown in FIGS. 1 and 2. The pig-tail 24 is a loose coil of metal or other rigid material through which the strand 14 is threaded. Other devices for aligning the strand 14 with the collector will be evident to those skilled in the art and further discussion thereof is not believed to be necessary.

The fiber strand 14 is wound about a portion 26 of a bobbin 28 supported upon a rotatable collector or spindle 30 of the winder 10 to form a wound package 12. Preferably the winder 10 is a strand twisting apparatus 34 or twist frame, shown in FIGS. 1 and 2, which imparts a twist to the strand 14 before winding to form a yarn. The twist is expressed in units of turns of twist per inch or meter. Suitable twist can be about 15 to about 50 turns per meter. The twist is also specified in terms of direction by a letter. Yarn has an S-twist if, when positioned vertically, the visible spirals or helices around its central axis assume an ascending right to left configuration, as in the central portion of the letter "S". In Z-twist yarn, the strands assume an ascending left to right configuration as in the central portion of the letter "Z". The present process is suitable for forming yarns having either S-twist or Z-twist.

The yarn can be plied by twisting a plurality of strands or cabled by twisting a plurality of plied yarns. For more information regarding the twisting of yarns, see *Loewenstein* at pages 333–339, which is hereby incorporated by reference.

The strand 14 or yarn is wound about a portion 26 of the bobbin 28 to form the primary layer 32 of the wound package 12. The bobbin can be any conventional bobbin well known to those skilled in the art. Preferably, the portion 26 of the bobbin 28 is generally cylindrical, although all or a portion of the cylinder can be conical. The portion 26 of the bobbin 28 can have one or more ridges 27, protrusions or irregularities, as desired. The bobbin can be made from any generally rigid, non-abrasive material, but preferably is made from a thermoplastic material such as high-impact polystyrene.

Non-limiting examples of suitable bobbins are shown as #28, #31, #33, #41, #53 and #96 in "PPG Fiber Glass Yarn Products and Packaging", a Technical Bulletin of PPG Industries, Inc. of Pittsburgh, Pa. (March 1994) at pages 3–4, which is hereby incorporated by reference. The preferred bobbin is PPG Industries bobbin #53, which has a top grip diameter of about 68.6 millimeters (mm), a barrel base inside diameter of about 83.1 mm, a base outside diameter of about 196.9 mm, a nominal yarn diameter of about 196.9 mm, a nominal traverse length of about 381.0 mm, a flange height of about 19.8 mm, an inside length of about 19.8 mm and an overall length of about 469.4 mm. For a further explanation of these dimensions, see "PPG Fiber Glass Yarn Products and Packaging" at page 3.

Other useful bobbins are disclosed in U.S. Design Pat. Nos. 292,643 and 282,312 and U.S. Pat. Nos. 4,600,165, 4,596,366 and 3,860,194, each of which is hereby incorporated by reference.

In a strand twisting apparatus 34, such as is shown in FIGS. 1 and 2, the bobbin 28 is supported or releasably mounted upon the rotatable collector or spindle 30, shown in phantom in FIG. 1. The spindle 30 has a base plate 31 with protruding drive lugs (not shown) which mate with the bottom flange 106 of the bobbin 28 to drive the bobbin. Methods and apparatus for securing the bobbin 28 to the spindle 30 are well known to those skilled in the art.

The spindle 30 and bobbin 28 are rotated at a speed of about 2500 to about 4500 revolutions per minute (rpm), and preferably about 3000 to about 4000 rpm. The spindle 30 is rotated by a spindle drive. The spindle 30 can include a pulley 36 driven by frictional contact with a rotating belt 38 of the drive, shown in FIGS. 1 and 2. The belt 38 frictionally engages a shaft of a motor, which supplies the force to rotate the belt 38. Any conventional motor capable of rotating the spindle 30 through the belt 38 at a generally constant speed would be useful in the present process. Preferably, the motor simultaneously rotates a plurality of spindles, such as are present on a conventional strand twisting apparatus 34 or twist frame. A non-limiting example of a suitable motor for rotating about 80 spindles is a 25 horsepower motor which is commercially available from Century. Alternatively, the spindle 30 can be rotated through a direct drive having a variable speed motor.

Non-limiting examples of suitable strand twisting apparatus 34 include a Model No. 8 twist frame, which is commercially available from Baco Machinery, Inc. Other suitable twist frames are commercially available from ICBT of France and Platt-Saco Lowell of Easley, S.C.

To align and control the deposition of the strand 14 upon the portion 26 of the bobbin 28 and the tightness of the layers of strand 14 deposited upon it, the strand 14 is passed through a traveler 40 or traverse having an eye 42, the traveler 40 being slidably engaged with a ring 46 which is reciprocated along a central axis of rotation 44 of the bobbin 28 as the strand 14 is wound around the bobbin 28 to form the wound package 12.

As shown in FIGS. 1 and 2, the ring 46 has an inner diameter 48 which is larger than the outer diameter 50 of the fully wound package 12. For example, for a wound package having an outer diameter of about 12.7 to about 25.4 centimeters (about 5 to about 10 inches), the ring 46 would have an inner diameter of about 15.2 to about 27.9 centimeters (about 6 to about 11 inches), respectively. The thickness of the ring 46 is generally about 6 to about 20 millimeters, and preferably about 8 to about 12 millimeters. The ring 46 can be formed from any generally rigid material, such as porous centered carbon steel. Preferably, the weight of the ring 46 is minimized to minimize the force needed to change the direction of travel of the ring 46 at the end of a stroke.

The ring 46 has a track 52 which secures the traveler 40 and permits the traveler 40 to circle the ring 46 in response to the forces exerted upon the strand 14 as the package 12 is wound. The tension in the strand 14 is influenced by the weight of the traveler 40. The traveler 40 can weigh about 0.1 grams to about 0.5 grams. The traveler 40 can be formed from any lightweight, rigid material, for example nylon for strand 14 having a tex of about 6 to about 200. As used herein, "tex" is the mass in grams per 1000 meters of strand length.

The eye 42 of the traveler 40 has a yarn contact surface 56 which can be varied in size or shape depending upon such factors as the type and weight of the strand 14. Preferably, the yarn contact surface 56 is c-shaped, although the yarn contact surface 56 can be of any shape desired. The size of the yarn contact surface 56 is about 5 to about 10 millimeters for receiving an average strand diameter of about 0.5 to about 1 millimeter.

During winding, the strand 14 between the traveler 40 and pig-tail 24 arcs or balloons about the package 12 to a certain extent depending upon the tension being exerted on the strand 14. The traveler 40 selected must have sufficient weight to prevent the strand 14 from interfering with other nearby equipment or processes and from contacting any other equipment surfaces, such as the partition 54, shown in FIGS. 1 and 2, which separates one winding position from another.

The winder 10 can also include a second ring 58 spaced apart from and located above the ring 46 to limit the diameter of the balloon. This second ring 58 is formed from a generally rigid material, such as aluminum. The second ring 58 is generally moved in coordination with the ring 46 as the ring 46 is reciprocated along the axis 44.

The winder 10 can further include a traverse drive for reciprocating the ring 46 with the traveler 40 and the second ring 58, if present, along the central axis of rotation 44 of the spindle 30 to deposit the strand 14 upon the portion 26 of the bobbin 28. Preferably, the ring 46 and second ring 58 are mounted upon a support 60 which permits the ring 46 and second ring 58 to maintain a constant distance 62 therebetween during reciprocation. The distance 62 can be about 10 about 30 centimeters, and preferably about 10 to about 20 centimeters, and is determined by such factors as strand mass so and feed rate.

Preferably, the ring 46 is attached on a first side 64 to a rigid first member 66 and on a second side (not shown) to a rigid second member 68 of the support 60. The first member 64 and second member 66 are preferably generally horizontal and are linked by a rigid member (not shown) which provides stability to the ring 46.

The second ring 58 is connected to a rigid support member 72, shown in FIG. 1 but omitted in FIG. 2 for purposes of clarity. The support member 72 is connected to the second member 68 such that the ring 46 and second ring 58 move in coordination along the axis 44 during winding.

The members 66, 68, 72 are formed from a rigid material such as aluminum or steel, preferably having a minimum mass to facilitate directional change of the ring 46 at the end of a stroke during winding.

The members 66, 68 are connected to a motor (not shown) which reciprocates the members 66, 68, ring 46 and second ring 58 along the axis 44 in response to electrical pulses received from a programmable logic controller, such as are available from Allen Bradley of Milwaukee, Wis. A non-limiting example of a suitable motor is a 1½ horsepower Indiana General motor. The reciprocal movement of the rings 46, 58, the movement of the traveler 40 and the rotation of the spindle 30 all contribute to the pattern in which the strand is placed in layers upon the bobbin 28, otherwise known as the "build".

As best shown in FIG. 1, in the present process, the fiber strand 14 is wound about a portion 26 of the bobbin 28 to form a primary layer 32 of the wound package 12. The primary layer 32 has an overall length 74, an upper portion 76 and a lower portion 78. The upper portion 76 has a length 80 which is less than the overall length 74. Preferably, the length 80 of the upper portion 76 is about 30 to about 70 percent of the overall length 74, and more preferably about 50 percent of the overall length 74. The lower portion 78 also has a length 82 which is less than the overall length 74, preferably about 30 to about 70 percent of the overall length 74, and more preferably about 50 percent of the overall length 74. The lower portion 78 is proximate the bottom flange 106 of the bobbin 28.

Referring to FIGS. 1 and 1*a*; the primary layer 32 comprises a plurality of sublayers 84. Each sublayer 84 comprises a plurality of layers 86. Each layer can be formed during a single stroke of the traverse along the axis 44. Each of the plurality of layers 86 is successively wound upon a preceding layer. For example, referring to FIG. 1*a*, a first layer 88 is formed on the bobbin 28 in the initial stroke of the traverse during winding. This first layer 88 becomes the preceding layer 90 when a second layer 92 is wound about the first layer 88. The second layer 92 would then become a preceding layer for a third layer 94 wound about the second layer. Each of these subsequent layers in the sublayer has a length which is less than the preceding layer, for example the length of the third layer 94 is less than the length of the second layer 92, which in turn is less than the length of the first layer 88. An end 126 of each of the layers 86 is proximate and can contact the bottom flange 106 of the bobbin 28.

Each of the plurality of layers 86 has an outer layer 102 having a length 104 which corresponds generally to the length 82 of the lower portion 78. When the portion 26 of the bobbin 28 upon which the strand 14 is wound is generally cylindrical, this process of building the primary layer 32 causes the lower portion 78 to have a generally cylindrical shape and the upper portion 76 to have a truncated generally conical shape, as shown in FIG. 1, other wise known to those skilled in the art as the initial stages for forming a "milk-bottle" build. An example of a fully wound package prepared using the milk-bottle build is shown in "PPG Fiber Glass Yarn Products and Packaging" at page 3 upon the #53 bobbin.

However, it has been discovered by the present inventors that when the package build is modified as set forth below during winding, trapped strands 14 near the bottom flange 106 of the bobbin and throughout the wound package 12 can be minimized or eliminated.

As shown in FIG. 2, in the process of the present invention, a secondary layer 108 is formed about the primary layer 32 using a different pattern or build than the milk-bottle build discussed above to form the wound package 12. This secondary layer 108 is formed about the primary layer 32 when the primary layer 32 constitutes about 80 to about 95 percent of the average depth 110 at the midpoint 122 of the wound package 12, and preferably about 85 to about 90 percent.

Referring to FIGS. 2 and 2*a*, the secondary layer 108 comprises a plurality of layers 112. Each of the plurality of layers 112 is successively wound upon a preceding layer. For example, referring to FIG. 2*a* a first layer 114 is formed on the primary layer 32 in the initial stroke of the traverse during winding of the secondary layer 108. This first layer 114 becomes the preceding layer 116 when a second layer 118 is wound about the first layer 114. The second layer 118 would then become a preceding layer for a third layer 120 wound about the second layer 118. Each of these subsequent layers has a length which is less than the preceding layer, for example the length of the third layer 94 is less than the length of the second layer 92, which in turn is less than the length of the first layer 88. The first layer 114 of each of the plurality of layers 112 preferably has a length which is generally equal to the overall length 74 of the primary layer 32.

The length of each of the plurality of layers 112 has a midpoint 122 which corresponds to a midpoint 124 of the overall length 74 of the primary layer 32. The build for the secondary layer is generally referred to as a "pirn" build. It has been discovered by the present inventors that the combination of package builds set forth above provides a wound package 12 in which trapped strands 14 near the bottom flange 106 of the bobbin 28 and throughout the wound package 12 are minimized or eliminated, a problem which heretofore has not been adequately addressed in the art.

The process according to the present invention for winding a fiber strand about a bobbin to form a wound package will now be described generally.

With reference to FIGS. 1 and 2, the process generally comprises the initial step of winding a fiber strand 14 about a portion 26 of a bobbin 28 supported upon a rotatable collector or spindle 30 of a winder 10 form the primary layer 34 of the wound package 12. The fiber strand 14 can be received from a fiber supply or forming package 16, which can be mounted upon a rotatable support 18. The rotatable support 18 can be driven by a drive, such as by a motor, preferably so as to feed the strand 14 to the winder 10 at a constant speed.

Preferably, the spindle 30 is also rotated by a spindle drive such that the bobbin is rotated, preferably at a speed slightly lower that the speed at which the strand 14 is fed. The strand 14 is threaded through the pig-tail 24 and traveler eye 42 and wound about the bobbin 28. The rings 46, 58 and traveler 40 are traversed along the axis 44 of the spindle 30 during winding to first form the primary layer 32 and subsequently the secondary layer 108. While it is preferred that the primary layer 34 and secondary layer 108 be adjacent, one skilled in the art would understand that intermediate layers of different build can be included in the wound package, or alternating primary and secondary layers 34, 108 can be used in the present process.

In forming the primary layer 32, the rings 46, 58 and traveler 40 are traversed or reciprocated along the axis 44 to form a plurality of sublayers 84. Each of the plurality of sublayers 84 comprises a plurality of layers 86. Each of the plurality of layers 86 of the sublayers 84 is successively wound upon a preceding layer and has a length less than the preceding layer, and has an outer layer 102 which corresponds generally to the length 82 of the lower portion 78, an end 126 of each of the layers 86 being proximate or contacting the bottom flange 106 of the bobbin 28.

A secondary layer 108 is formed upon the primary layer 28 by traversing or reciprocating the rings 46, 58 and traveler 40 along the axis 44 in a different pattern from that used to form the primary layer 28. The secondary layer 108 is formed from a plurality of layers being successively wound upon a preceding layer and having a length which is less than the preceding layer. The length of each of the plurality of layers has a midpoint 122 which corresponds in position to the midpoint 124 of the primary layer 32, such that a wound package 12 is formed.

The process of the present invention will now be illustrated by the following specific, non-limiting examples.

EXAMPLE 1

Each of five sample supply packages was wound with a G-75 glass fiber strand. The strand is commercially available as textile product No. 610 of PPG Industries, Inc. of Pittsburgh, Pa.

Each of the supply packages was mounted upon a respective support of a Model 8 twist frame, which is commercially available from Baco Machinery, Inc. The strand from each package was threaded through a respective pig-tail and traveler eye as discussed above. The strand was wound about a type #53 bobbin which is shown in "PPG Fiber Glass Yarn Products and Packaging" at pages 3–4. The supply package was rotated such that the strand was fed to the winder at a rate of about 120 to about 150 meters/minute. The bobbin was rotated at a speed of about 3000 to about 4000 rpm. The typical winding time for winding such a package is about 1000 to about 1100 minutes. The primary layer of the package was wound according to the present process as set forth above. During about the last 16 minutes of winding, the build was changed to form a secondary layer upon the primary layer as set forth above.

When each of the five packages wound according to the present invention set forth above was unwound, the strand did not break and unwinding was not interrupted by strands trapped near the bottom flange of the bobbin or elsewhere throughout the package.

EXAMPLE 2

Each of ten sample supply packages was wound with a G-75 glass fiber strand. The strand is commercially available as textile product No. 615 of PPG Industries, Inc. of Pittsburgh, Pa.

Each of the supply packages was mounted and the strand threaded and wound as discussed above. The rate at which strand was fed to the winder and rotational speed of the bobbin were about the same as for Example 1 set forth above. The primary layer of the package was wound as set forth above. During about the last 60 minutes of winding, the build was changed to form a secondary layer upon the primary layer as set forth above.

When each of the packages wound according to Example 2 of the present invention set forth above was unwound, the strand did not break and unwinding was not interrupted by strands trapped near the bottom flange of the bobbin or elsewhere throughout the package.

From the foregoing description, it can be seen that the present invention provides a simple, economical process for reducing or eliminating trapped strands from wound packages, both near the bottom flange and throughout the package, as well as to providing a generally uniform tension to the strand. The present process facilitates winding, manipulation and transportation of packages to reduce waste and increase efficiency and productivity.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

Therefore, we claim:

1. A process for winding a fiber strand about a bobbin to form a wound package, the process comprising the steps of:

(a) winding a fiber strand about a portion of a bobbin supported upon a rotatable collector of a winder to form a primary layer of a wound package, the primary layer having an overall length, an upper portion and a lower portion, each of the upper portion and lower portion having a length which is less than the overall length, the primary layer comprising a plurality of sublayers, each of the plurality of sublayers comprising a plurality of layers, each of the plurality of layers of the sublayers being successively wound upon a preceding layer and having a length which is less than the preceding layer, each of the plurality of layers of the sublayers having an outer layer having a length which corresponds generally to the length of the lower portion, such that the primary layer is formed; and (b) forming a secondary layer comprising a plurality of layers upon the primary layer, each of the plurality of layers being successively wound upon a preceding layer and having a length which is less than the preceding layer, the length of each of the plurality of layers having a midpoint which corresponds to a midpoint of the overall length of the primary layer, such that a wound package is formed.

2. The process according to claim 1, wherein the winder is a strand twisting apparatus.

3. The process according to claim 2, wherein the strand twisting apparatus comprises a spindle having the bobbin releasably mounted thereon.

4. The process according to claim 3, wherein the strand twisting apparatus further comprises a spindle drive for rotating the spindle.

5. The process according to claim 3, wherein the process further comprises rotating the spindle at a predetermined speed during winding, such that the bobbin is rotated at the predetermined speed.

6. The process according to claim 2, wherein the strand twisting apparatus comprises a traveler for aligning the fiber strand during winding.

7. The process according to claim 6, wherein the strand twisting apparatus further comprises a traverse drive for reciprocating the traveler along a central axis of rotation of the bobbin.

8. The process according to claim 6, wherein the process further comprises reciprocating the traveler along a central axis of rotation of the bobbin during winding, such that the fiber strand is reciprocated along the central axis.

9. The process according to claim 6, wherein the strand twisting apparatus further comprises a support upon which the traveler is mounted, the support being reciprocated along a central axis of rotation of the bobbin during winding to form the wound package.

10. The process according to claim 1, wherein the process further comprises supplying a fiber strand to the winder.

11. The process according to claim 10, wherein the fiber strand is supplied to the winder at a variable speed.

12. The process according to claim 1, wherein the wound package has a length essentially equal to the overall length of the primary layer.

13. The process according to claim 1, wherein the lower portion has a length of about one-half the overall length of the primary layer.

14. The process according to claim 1, wherein each of the plurality of layers of the secondary layer comprises a first layer having a length generally equal to the overall length of the primary layer.

15. The process according to claim 1, wherein the process further comprises rotating the bobbin at a predetermined speed.

16. A wound package produced according to the process of claim 1.

* * * * *